US006345456B1

(12) United States Patent
Bracken

(10) Patent No.: US 6,345,456 B1
(45) Date of Patent: Feb. 12, 2002

(54) CALENDAR FRAME

(76) Inventor: Ann Bracken, 1348 S. Main St., Blacksburg, VA (US) 24060

( * ) Notice: Subject to any disclaimer, the term of this patent is extended or adjusted under 35 U.S.C. 154(b) by 0 days.

(21) Appl. No.: 09/435,438

(22) Filed: Nov. 22, 1999

(51) Int. Cl.[7] ..... G09D 3/00

(52) U.S. Cl. ..... 40/107; 40/120; 40/121; 40/726; 40/735; 283/2

(58) Field of Search ..... 40/107, 120, 121, 40/726, 735, 768, 790, 791, 792, 793, 794, 795; 283/2; 402/60, 64, 68

(56) References Cited

U.S. PATENT DOCUMENTS 1,153,544 A * 9/1915 Eddy ..... 40/121
1,836,626 A * 12/1931 Stevens ..... 40/121
2,743,011 A * 4/1956 Woofter ..... 40/107
2,789,836 A * 4/1957 Jeannin ..... 40/120 X
3,605,306 A * 9/1971 Diambra et al. ..... 40/107
4,250,639 A * 2/1981 Tarrant ..... 40/107
4,703,571 A * 11/1987 McCarthy ..... 40/107
4,761,091 A * 8/1988 Ominato et al. ..... 402/60 X
5,106,122 A * 4/1992 Perelman ..... 40/107 X
5,273,155 A * 12/1993 Sala ..... 40/107 X

* cited by examiner

*Primary Examiner*—Lynne H. Browne
*Assistant Examiner*—James M. Hewitt
(74) *Attorney, Agent, or Firm*—James W. Hiney

(57) ABSTRACT

A permanent calendar frame which can display both a artistic picture and a monthly calendar and which has two spaces, one for the picture and the second for the calendar, the calendar being adapted to be advanced monthly by merely flipping a pivotable two peg securement so as to flip to the new month and engage holes in the calendar expressly for engagement by the two peg securement.

4 Claims, 4 Drawing Sheets

FIG. 3
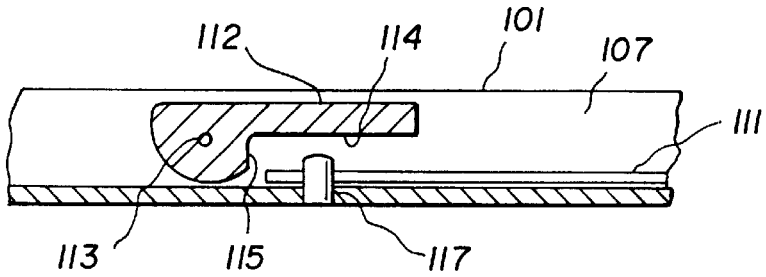
FIG. 4
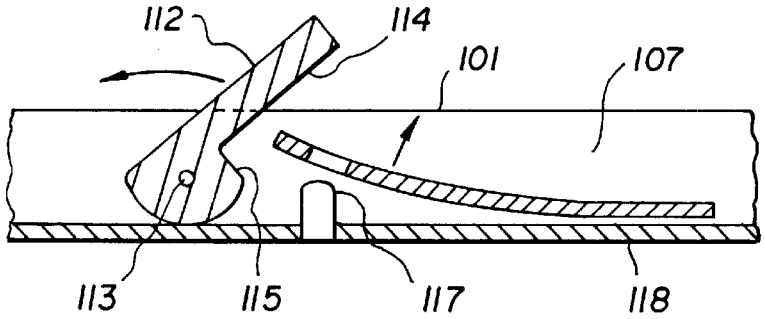
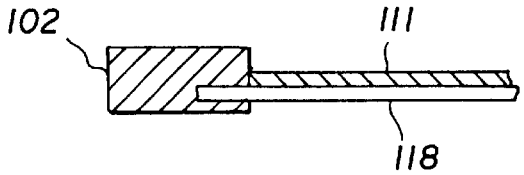
FIG. 5
FIG. 6
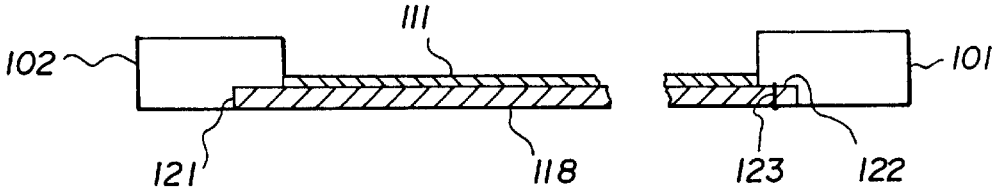

CALENDAR FRAME

This invention relates to calendar frames which are uniquely designed to display an art rendering while also displaying a calendar which is easy to connect to said frame, is interchangeable with the subsequent year calendar and wherein monthly calendar pieces can be easily removed and discarded and wherein a user may make notes of information related to the information on said calendar.

THE PRIOR ART

Henceforth, display calendars have either been a one-piece foldable device which is hung by a pin or the like and the user turns the calendar over each month to display a new month or have been rigid frames where the calendar portions occupy the entire display area and the pages of which are either torn off with each passing month or where the entire frame must be taken down to remove that month's page and a new one inserted. Only the calendar is displayed in the prior art and the overall piece does not set a decorative tone or allow for decorative artwork to be simultaneously displayed. This is important as the decorative aspect of a frame hanging is what people wish to place on the walls of their residence or work place.

THE INVENTION

The instant calendar removes all those detrimental features of the prior art by first presenting a decorative artwork in conjunction with a solid, well constructed frame which taken by themselves make for an attractive hanging. The instant invention also allows for the user to display a calendar or other information on the frame in a fashion which is pleasing to the eye and is easy to adjust for the passing of each month. The information bearing sheets are hung on two pegs and a pivotal center piece pivots downward to keep the sheets in place on the pegs. When a user wishes to remove the top calendar sheet upon the expiration of the month, he or she merely pivots up the center piece, removes the top sheet and pivots the center piece down in place again. There is no tearing, removing and flipping of the entire calendar or placing a new sheet in place. The sheets are merely stacked on the pegs and held there by the center piece and easily removed upon the expiration of each month.

OBJECTS OF THE INVENTION

Accordingly, it is an object of the invention to provide a novel calendar which acts as a display foundation for art, provides an datable annual calendar and allows for notations to be made by the user corresponding to events within the calendar month shown.

It is a further object of this invention to provide a permanent display frame to provide for a calendar and/or note pad which allows continuous use year after year and which is used simultaneously to provide a display of art.

These and other objects will become apparent when reference is had to the accompanying drawings in which.

DESCRIPTION OF DRAWING FIGURES

Figure 1:
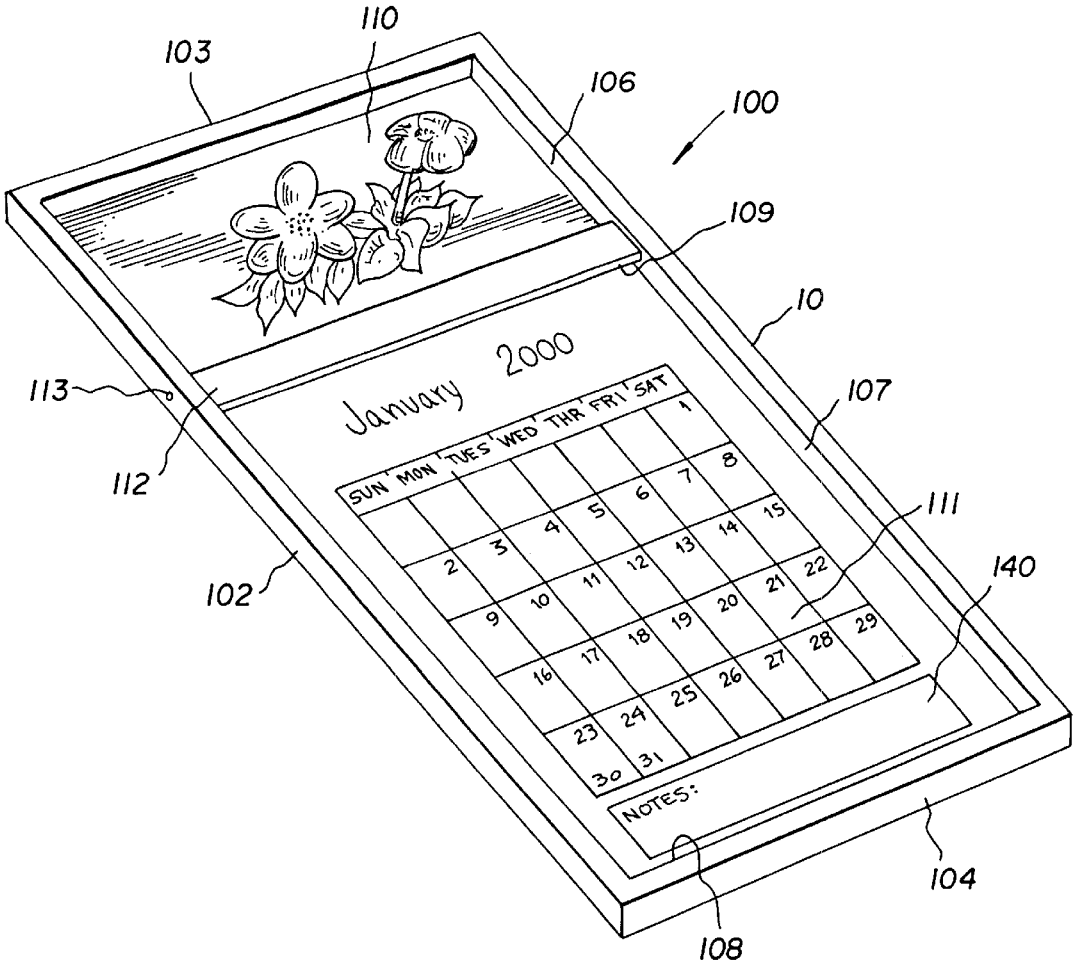
FIG. 1 is a perspective view of the frame constituting this invention.
Figure 2:
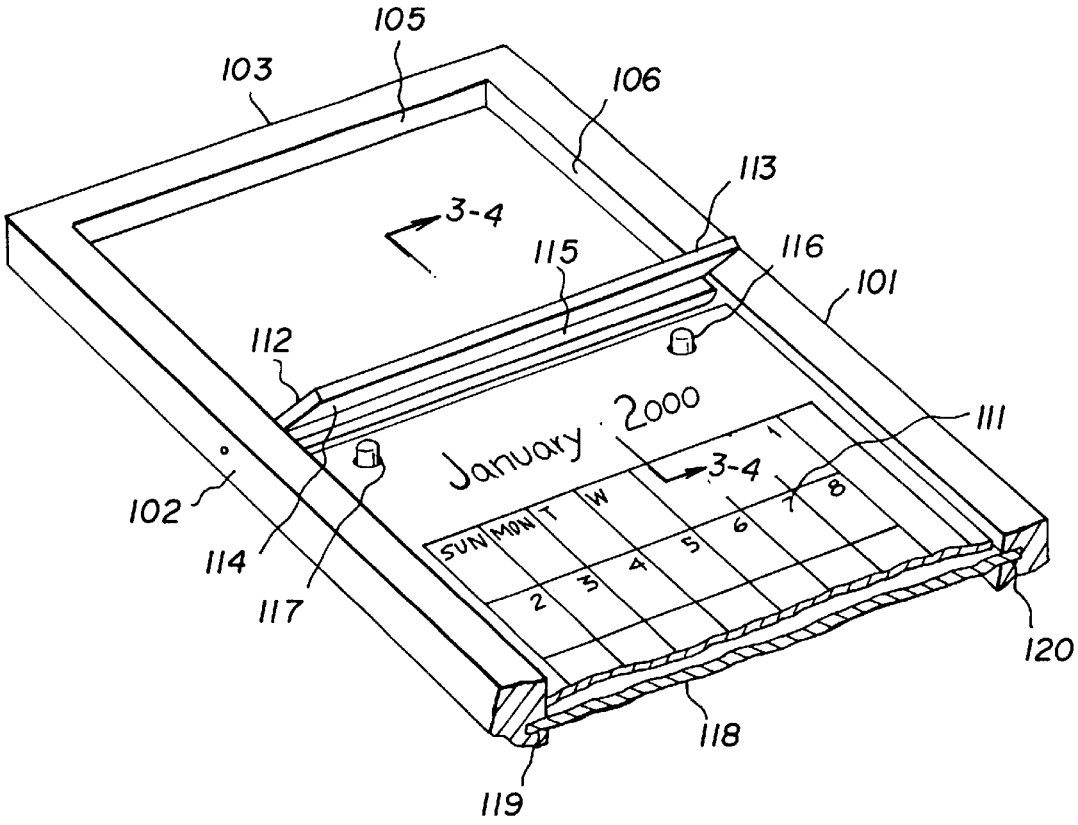
FIG. 2 is a partial view of the frame of FIG. 1 showing the center piece swung away position.
Figure 7:
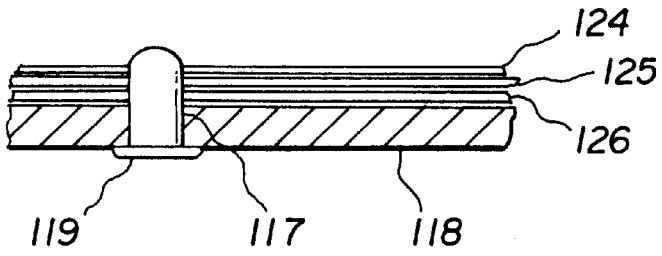
Figure 8:
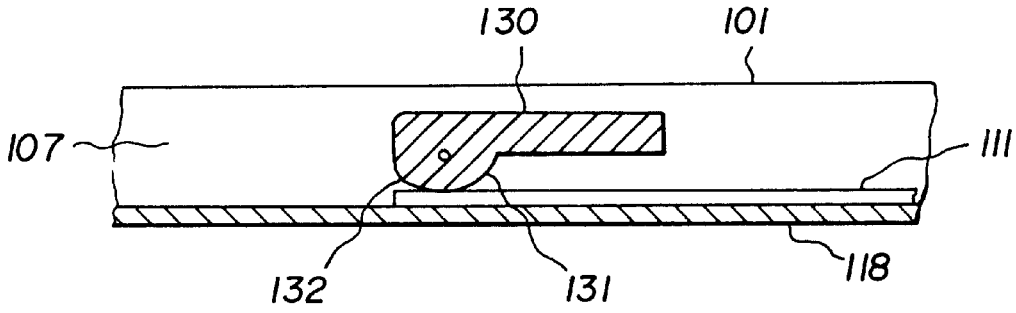
Figure 9:
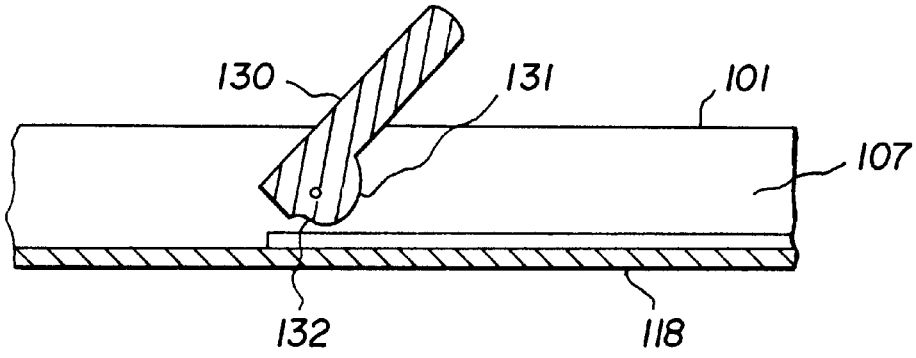

FIG. 3 is a cross-section taken on line 3-4 of FIG. 2 showing the center piece in locking position, FIG. 4 is a cross-section taken on line 3-4 of FIG. 2 showing the center piece in unlocked position, FIG. 5 is a cross-section of a portion of the frame of FIG. 1 showing the backing board in place, FIG. 6 is a cross-section of the portion of the frame of FIG. 1 showing another configuration of the backing board and method of attaching it to the frame, FIG. 7 shows a cross-section of the peg mount and calendar sheets of the frame, FIG. 8 shows an alternative center locking piece in place on the frame in locked position, and FIG. 9 shows the alternative center locking piece of FIG. 8 on the frame in unlocked position.

DETAILED DESCRIPTION OF THE INVENTION

Referring to FIG. 1 there is shown the frame 100 having elongated side portions 101 and 102 and connecting top and bottom portions 103 and 104, these portions are generally rectangular but can be other cross-sectional shapes. The portions have inside walls as 106 and 108 which define two generally rectangular spaces. The first or upper space defines an area for display of an artwork 110. The lower space defines an area for insertion of a calendar 111. Separating the two spaces is a pivoting center portion 112 which has a first edge 109 and is pivoted as at 113. The lower portion of the calendar may have a space thereon as at 140 for making notes.

FIG. 2 shows the same frame 100 only with the center piece pivoted up so as to expose and release the piece from maintaining the calendar sheets on two pegs, 116 and 117. The center piece 112 has edge 113 flat area 114 and a lip portion 115 which supports the pivot pin 113. The lower end of the calendar shows backing board 118 fitted into grooves in the side portions 101 and 102.

FIG. 5 shows the backing board fitting in rectangular grooves in portion 102. The calendar 111 lays atop the backing board. Another way to secure the backing board to the frame is shown in FIG. 6 wherein the backing board is secured within grooves 122 with edges 121 by nails or screws 123.

FIG. 3 shows the center piece 112 in locking position where the flat portion 114 of the piece lays atop the top of the pegs 116 and 117. When the locking piece is swiveled upward as shown in FIG. 4 the lip 115 is swung upwardly and the flat area 114 is no longer abutting the tops of the pegs 116 and 117 and the calendar 111 is allowed to be swung upwardly and away from the backing board 118. This position of the center piece allows for easy removal of the pages of the calendar each month without having to take the frame down. It is very simple and one merely grasps the center piece and pivots it upwardly away from the backing board to afford access to the calendar.

FIG. 7 shows the layers 124, 125, 126, representing individual pages of the calendar atop the backing board and having holes punched therein which engage the pegs such as 117.

FIGS. 8 and 9 show an alternative center piece which relies on a wedging technique to hold the top of the calendar in place. The bottom portion of the calendar pages abut the inside edge 108 of the lower frame portion 104. The center piece 130 has a rounded portion 131 so shaped so as to engage the top of the calendar pages when in the position shown in FIG. 8 but to release them for removal of the top sheet when pivoted upwardly as shown in FIG. 9. Portion 132 is configured so as to allow for engagement of the pages without interfering with the pivotal movement of the piece.

Having described the invention and its operation and the preferred embodiment it will be obvious to those of ordinary skill in the art to make many changes and modifications without departing from the scope of the appended claims.

What is claimed is:

1. A permanent frame for displaying both art and a calendar, said frame comprising:

a generally rectangular frame for holding both an artistic picture therein and displaying the calendar, said frame defining a first space for displaying the artistic picture therein and a second space below said first space for displaying the calendar consisting of several sheets of removable time information, pivotal calendar retaining means separating said first and second spaces, securement means for holding the calendar in place in said frame whereby the sheets of the calendar can be easily removed from said second space, frame side members, a backing board which is attached to said frame and is for supporting the calendar and artistic picture, wherein said backing board is secured to said frame by reason of grooves in said frame side members.

2. A permanent frame as in claim 1 wherein said pivotal calendar retaining means comprises an elongated member separating said two spaces and having a portion thereon adapted to cooperate with said securement means for holding the calendar in place.

3. A permanent frame as in claim 2 wherein said securement means comprises two pegs attached to said backing board and cooperating with said elongated member for holding the calendar having holes therein aligned with said pegs.

4. A permanent frame as in claim 3 wherein said elongated member has a flat surface thereon adapted to abut the pegs for holding the calendar in place.

* * * * *